US008822004B2

(12) United States Patent
Verdisco

(10) Patent No.: US 8,822,004 B2
(45) Date of Patent: Sep. 2, 2014

(54) MINERAL MAT

(76) Inventor: Elizabeth Jayne Verdisco, Thornton, CO (US)

( * ) Notice: Subject to any disclaimer, the term of this patent is extended or adjusted under 35 U.S.C. 154(b) by 311 days.

(21) Appl. No.: 13/299,426

(22) Filed: Nov. 18, 2011

(65) Prior Publication Data

US 2012/0135178 A1 May 31, 2012

Related U.S. Application Data

(60) Provisional application No. 61/415,265, filed on Nov. 18, 2010.

(51) Int. Cl.
*A45D 33/02* (2006.01)
*A45D 44/02* (2006.01)
*A45C 9/00* (2006.01)

(52) U.S. Cl.
CPC .. *A45D 44/02* (2013.01); *A45C 9/00* (2013.01)
USPC ..... 428/54; 428/53

(58) Field of Classification Search
USPC ..... 428/54, 53
See application file for complete search history.

(56) References Cited

U.S. PATENT DOCUMENTS

2002/0114539 A1 * 8/2002 Strevey et al. ..... 383/13

* cited by examiner

*Primary Examiner* — Brent O'Hern
(74) *Attorney, Agent, or Firm* — Duft Bornsen & Fettig LLP

(57) ABSTRACT

An apparatus for collecting make-up residue. One embodiment comprises a mat configured to collect the make-up residue. The mat includes a first side section and a second side section connected by a center section. The first side section and the second side section are able to open about the center section so that the mat lies substantially flat. This allows for collection of make-up residue that falls on top surface of the mat. The first side section and the second side section are also able to fold about the center section into a U-shape (or V-shaped) so that the make-up residue resting on the top surfaces of the first side section and the second side section falls toward the center section. When the make-up residue falls into the center section, the make-up residue may be poured from the center section, such as into a container.

16 Claims, 7 Drawing Sheets

MINERAL MAT

RELATED APPLICATIONS

This non-provisional application claims priority to U.S. provisional application 61/415,265, filed on Nov. 18, 2010, which is incorporated herein by reference as if fully provided herein.

FIELD OF THE INVENTION

The invention relates to the field of cosmetics products.

BACKGROUND

People use cosmetics products on a daily basis to enhance their appearance. Some of the cosmetics products, also referred to as "make-up", are a loose powder that is applied with a brush or the like. When the loose powder make-up is applied, some of the make-up will fall as residue onto the surface below which can cause an undesirable mess.

SUMMARY

Embodiments provided herein include a mat that is configured to catch the residue that falls when applying make-up. The mat is able to lie substantially flat upon the surface of a countertop, sink, etc. When the mat is laid flat, the make-up residue lands on the top surface of the mat as an individual applies make-up over the mat. The mat is also able to fold into a U-shape or V-shape after the individual is finished applying make-up. When the mat is folded, the make-up residue collects toward the center of the mat. The make-up residue may then be poured back into a make-up container for reuse, or may be disposed of. The mat described above advantageously catches make-up so that it does not make a mess on the countertop or sink, and also allows the make-up residue to be reused. This can be especially useful for mineral make-ups that are expensive and difficult to clean.

When the mat is folded, the mat may also be used as a pouch or bag. The mat may include a closure or fastener that allows the mat to maintain its folded shape. For example, the mat may include a zipper, magnetic or other closures around its perimeter that allow the mat to maintain its folded shape as a pouch. The mat may therefore be used as a pouch to hold make-up or other items.

One embodiment comprises a mat configured to collect make-up residue. The mat includes a first side section and a second side section connected by a center section. The first side section and the second side section are able to open about the center section so that the mat lies substantially flat. This allows for collection of make-up residue that falls on the top surface of the mat (i.e., the top surfaces of the first side section, the second side section, and the center section). The first side section and the second side section are also able to fold about the center section into a U-shape (or a V-shape) so that the make-up residue resting on the top surfaces of the first side section and the second side section falls into the center section. When the make-up residue falls into the center section, the make-up residue may be poured from the center section, such as into a container.

In another embodiment, the mat further includes a pour spout that extends from the center section to assist in pouring the make-up residue from the center section.

In another embodiment, the mat further includes one or more weights affixed to the first side section and the second side section to assist in holding the mat substantially flat when opened.

In another embodiment, the mat further includes a carry handle affixed to the first side section and the second side section to allow the mat to be carried while folded into the U-shape.

In another embodiment, the mat further includes a closure mechanism, such as a zipper, a magnetic closure, etc, that are adapted to fasten the first side section to the second side section in the U-shape so that the mat acts as a pouch when folded.

In another embodiment, the mat further includes one or more rigid members affixed to at least a portion of the perimeter of the first side section and the second side section.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
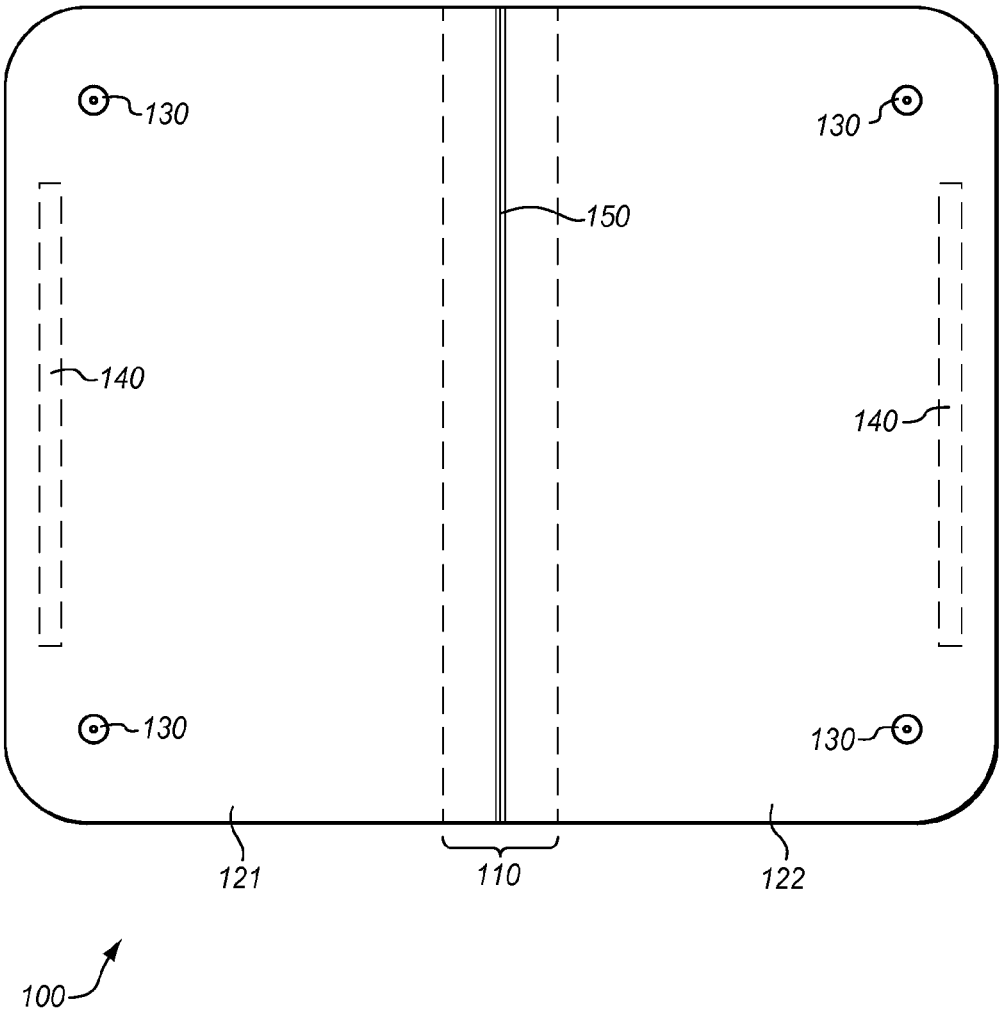
FIG. 1 is a top view of a mat that collects make-up residue in an exemplary embodiment.

FIG. 1 is a top view of a mat 100 that collects make-up residue in an exemplary embodiment. Mat 100 includes a center section 110 that connects to side sections 121 and 122. Mat 100 is in an open configuration in FIG. 1 so that side sections 121-122 are substantially flat in relation to center section 110 (or co-planar to center section 110). When mat 100 is in the open configuration, it may be set upon a countertop, a sink, or some other surface.

Side sections 121-122 may be made from a substantially flexible material. The flexible material would allow mat 100 to conform to the surface it rests upon. In one embodiment, one or more weights 130 may optionally be affixed (internally or externally) to side sections 121-122 to assist in holding mat 100 open and substantially flat. In order to add rigidity to mat 100, one or more rigid members 140 may be affixed (internally or externally) near the perimeter of side sections 121-

122. Rigid members 140 may be decorative, such as bamboo sticks affixed to the bottom surface of side sections 121-122 near their perimeter. Rigid members 140 may alternatively be a wire or the like internally affixed to side sections 121-122 near their perimeter.

Center section 110 may be made from a flexible or substantially rigid material. If center section 110 is substantially rigid, section 110 may have a curved or concave shape so that mat 100 may have a U-shape when folded. Also, a crease 150 (or groove/channel) may be pressed or formed in center section 110 to facilitate pouring of make-up residue from mat 100, as is further described below.

With mat 100 opened on a countertop, sink, etc, an individual may apply make-up above mat 100. When the individual applies the make-up, residue will fall on the top surface of mat 100 (i.e., the top surface of center section 110 and side sections 121-122) instead of on the countertop, sink, etc. When the individual is finished applying make-up, the individual may fold mat 100 so that the make-up residue accumulates in center section 110 of mat 100.

Figure 2:
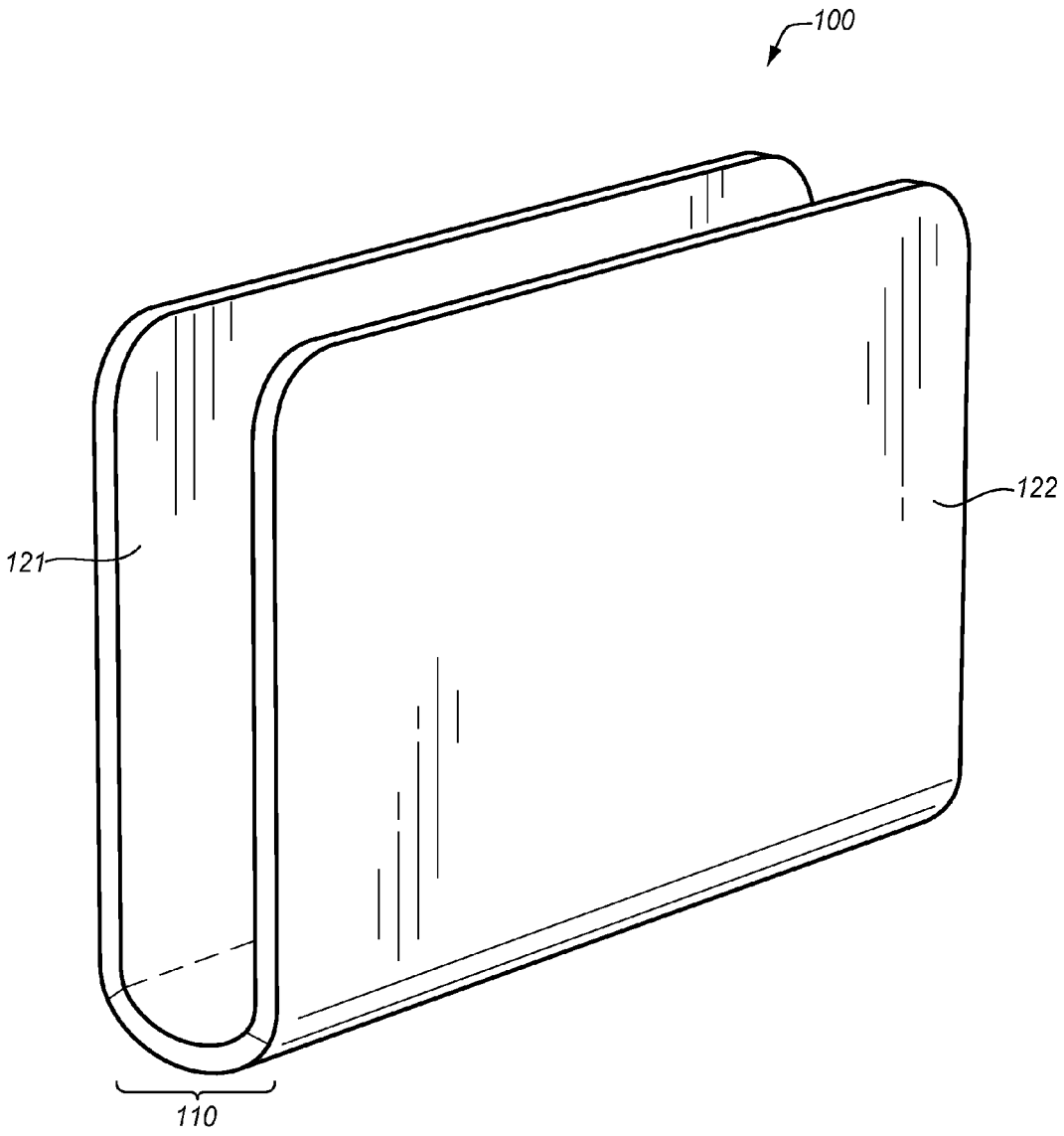
FIG. 2 is an isometric view of the mat when folded in an exemplary embodiment.

FIG. 2 is an isometric view of mat 100 when folded in an exemplary embodiment. As shown in FIG. 2, mat 100 is able to fold about center section 110 into a U-shape (or V-shape). Thus, side sections 121-122 are substantially perpendicular to center section 110. When mat 100 is in a folded configuration, the make-up residue that rests on the top surfaces (as shown in FIG. 1) of side sections 121-122 will fall into center section 110 and accumulate in center section 110. Side sections 121-122 or the top surfaces of side sections 121-122 may be fabricated from a non-stick material so that the make-up residue falls into center section 110 and does not stick to the top surface of side sections 121-122. For example, side sections 121-122 and/or the top surfaces of side sections 121-122 may be fabricated from a Teflon® material, a nylon material, a recycled material, etc.

Figure 3:
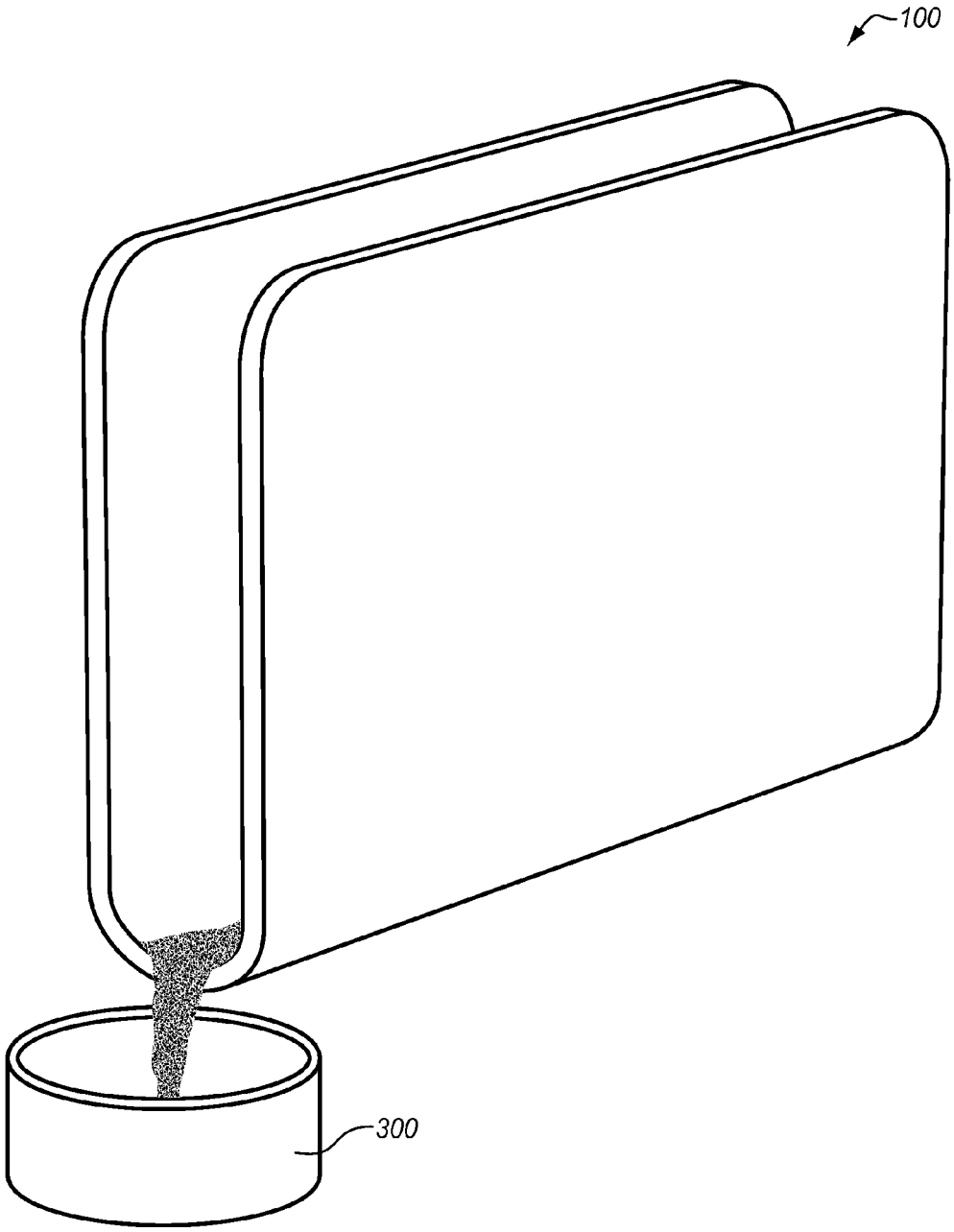
FIG. 3 is an isometric view of the mat with the make-up residue being poured into a container in an exemplary embodiment.

After the make-up residue falls into center section 110, mat 100 may be tipped to allow the make-up residue to be poured from center section 110. FIG. 3 is an isometric view of mat 100 with the make-up residue being poured into a container 300 in an exemplary embodiment. Container 300 may be the original container for the make-up that was applied. Therefore, instead of the make-up residue being wasted, the residue may be poured back into the make-up container and reused.

Figure 4:
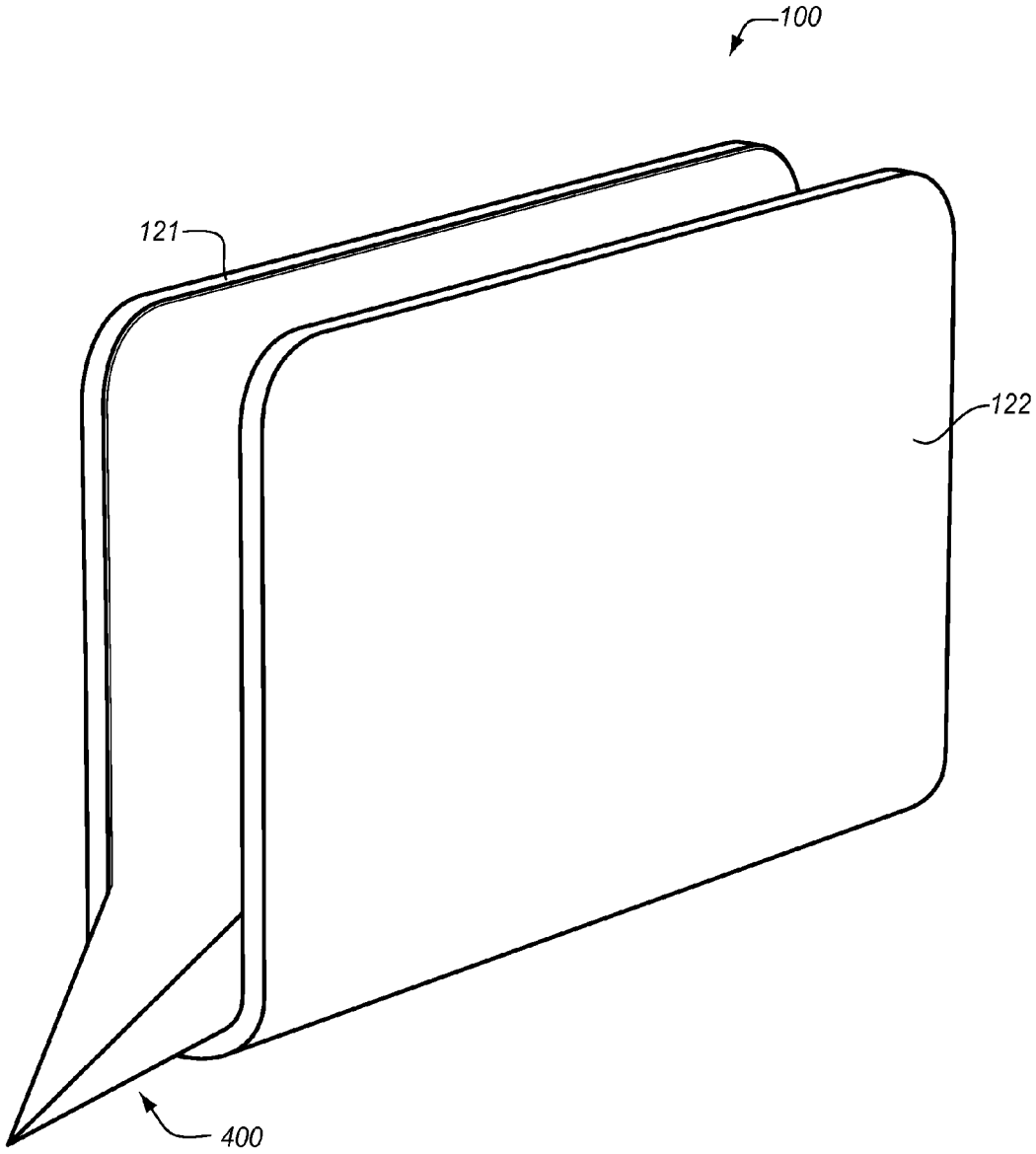
FIG. 4 is an isometric view of the mat with a pour spout in an exemplary embodiment.

In order to assist in pouring the make-up residue into container 300, mat 100 may include a pour spout. FIG. 4 is an isometric view of mat 100 with a pour spout 400 in an exemplary embodiment. Pour spout 400 extends from center section 110 so that the make-up residue may be directed into a container when mat 100 is tipped. In the embodiment shown in FIG. 4, pour spout 400 may be folded into center section 110 when it is not being used. When removing make-up residue from mat 100, pour spout 400 may be unfolded so that it extends outward from center section 110.

Figure 5:
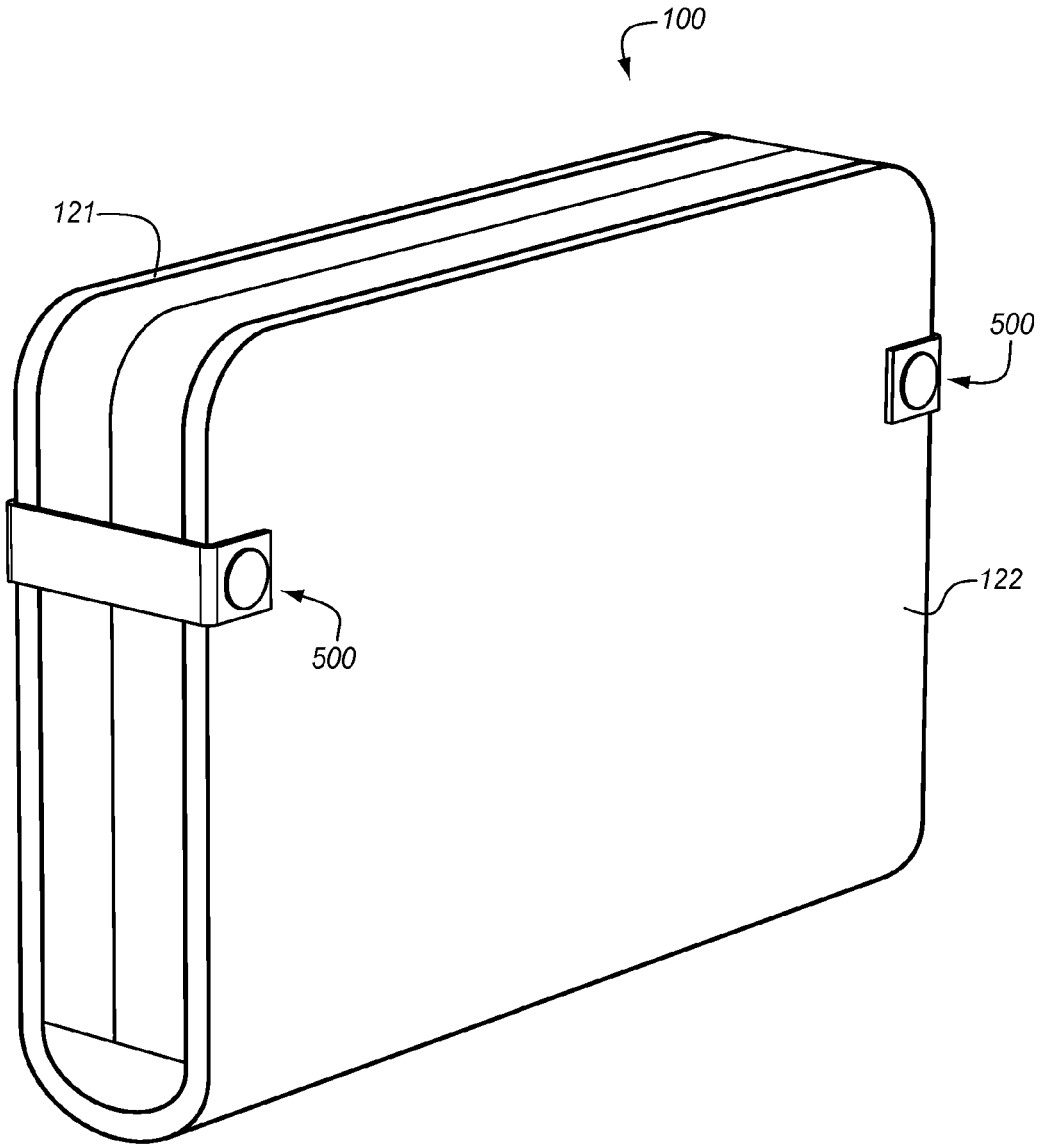
FIG. 5 is an isometric view of the mat as a pouch in an exemplary embodiment.
Figure 6:
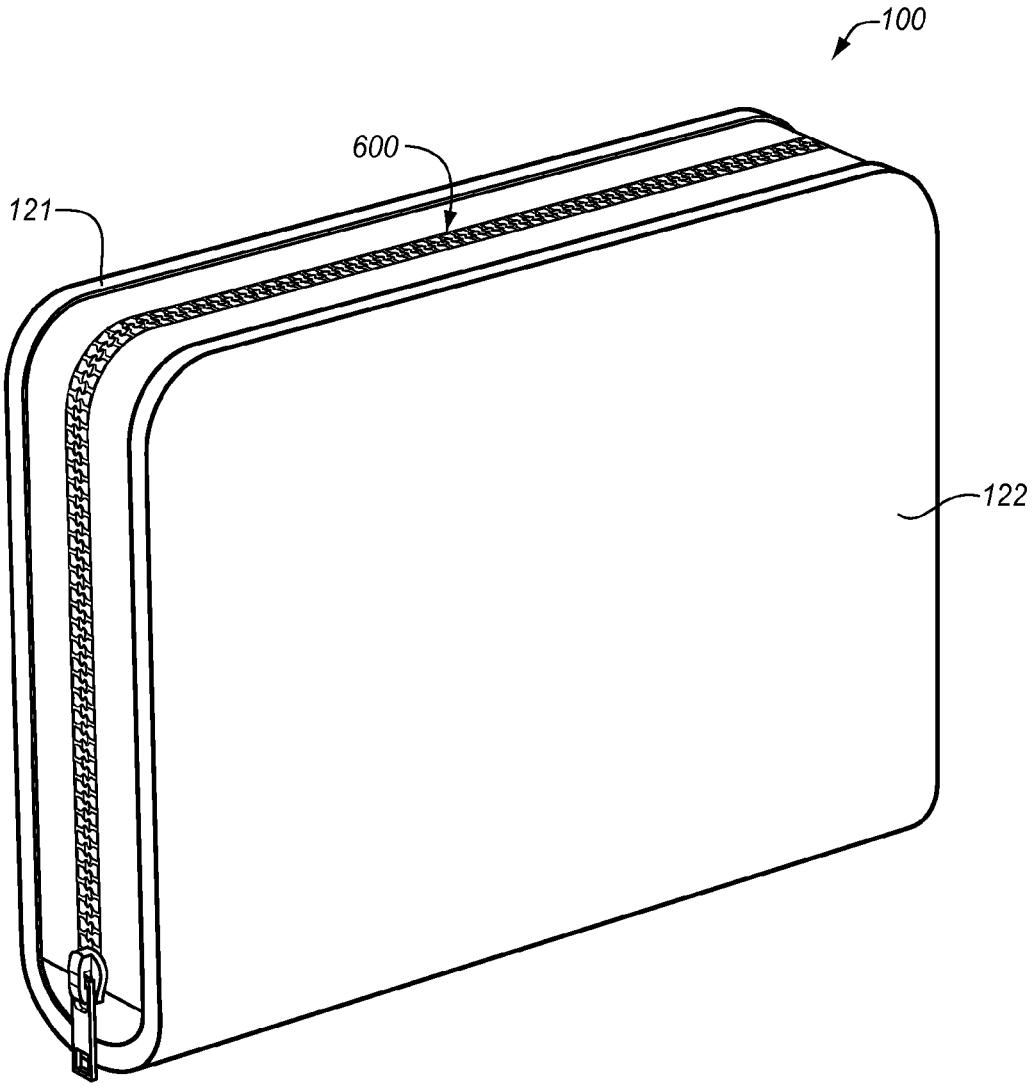
FIG. 6 is an isometric view of the mat with a zipper closure in an exemplary embodiment.

In another embodiment, mat 100 may be used as a bag or pouch when folded. FIG. 5 is an isometric view of mat 100 as a pouch in an exemplary embodiment. As shown in FIG. 5, mat 100 may further include a closure mechanism 500 that fastens one side section 121 to the other side section 122 in the U-shape so that mat 100 acts as a pouch when folded. Closure mechanism 500 may comprise buttons, snaps, a zipper, a magnetic closure, or any other desired fastener. For example, mat 100 may include a zipper 600 that runs along the perimeter of side sections 121-122 so that the zipper 600 fully encloses mat 100 when folded, as illustrated in FIG. 6.

With the addition of closure mechanism 500, mat 100 is dual purpose. Mat 100 may be used to collect make-up residue and pour the residue into a container. When mat 100 is folded and side sections 121-122 are fastened to one another with closure mechanism 500, mat 100 may be used as a bag for carrying/storing make-up, brushes, etc.

Figure 7:
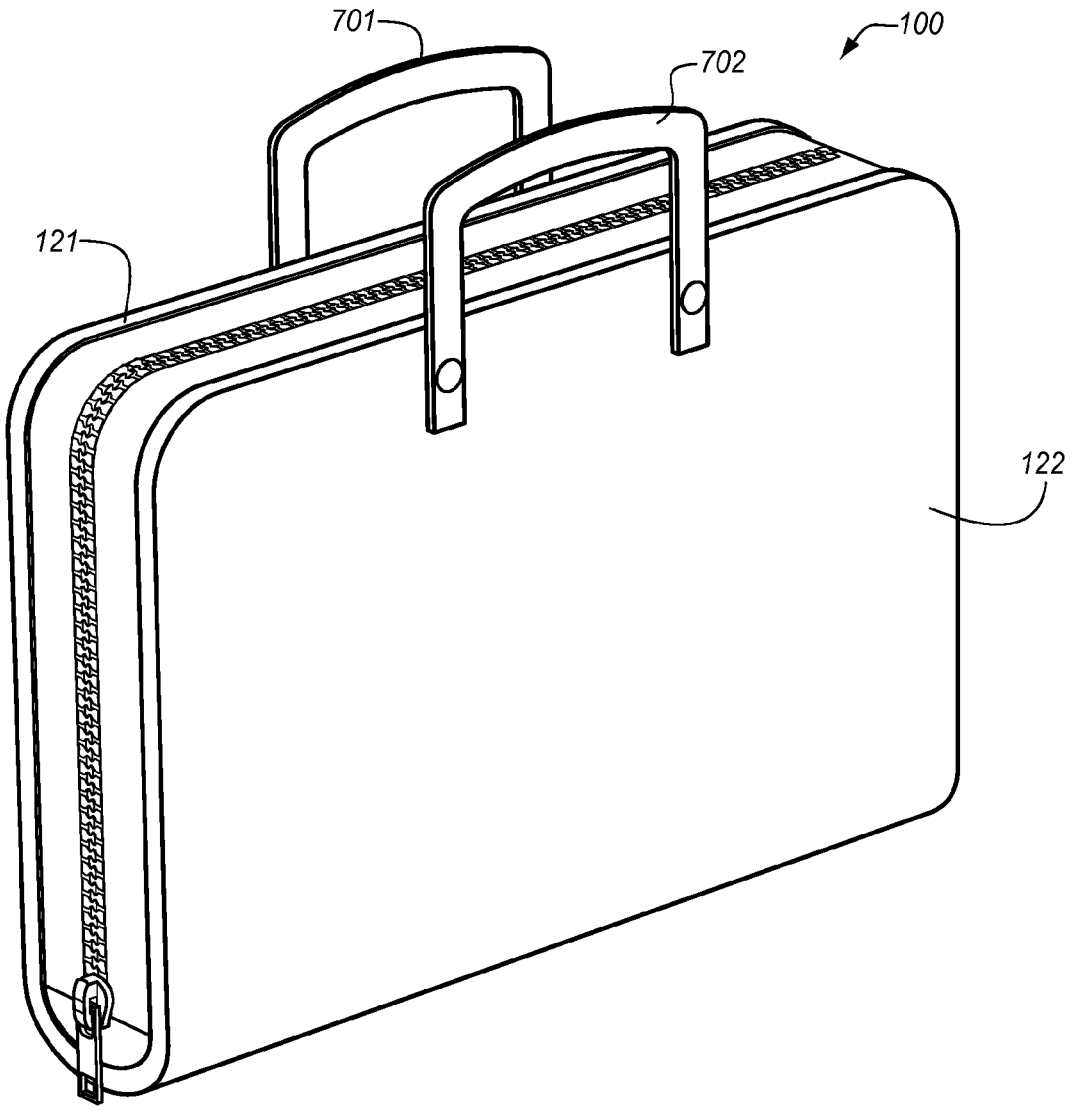
FIG. 7 is an isometric view of the mat with handles in an exemplary embodiment.

To allow mat 100 to be easily carried when configured as a pouch, mat 100 may include one or more handles. FIG. 7 is an isometric view of mat 100 with handles 701-702 in an exemplary embodiment. Handle 701 is affixed to side section 121, and handle 702 is affixed to side section 122. When mat 100 is folded as shown in FIG. 7, handles 701-702 are positioned side-by-side so that an individual may grasp handles 701-702 and lift/carry mat 100. Handle 701 and/or handle 702 may be affixed to any desired position on mat 100, as FIG. 7 illustrates just one example.

Although specific embodiments were described herein, the scope of the invention is not limited to those specific embodiments. The scope of the invention is defined by the following claims and any equivalents thereof.

I claim:

1. An apparatus comprising:

a mat configured to collect make-up residue, the mat comprising:

a first side section and a second side section connected by a center section;

the first side section and the second side section are able to open about the center section so that the mat lies substantially flat to allow for collection of make-up residue that falls on top surfaces of the first side section, the second side section, and the center section;

the first side section and the second side section are also able to fold about the center section into a U-shape so that the make-up residue resting on the top surfaces of the first side section and the second side section falls into the center section to allow the make-up residue to be poured from the center section; and a pour spout that unfolds to extend outward from the center section to assist in pouring the make-up residue from the center section;

the pour spout folds into the center section when not in use.

2. The apparatus of claim 1 further comprising:

at least one weight affixed internally to the first side section and the second side section to assist in holding the mat substantially flat when opened.

3. The apparatus of claim 1 further comprising:

a carry handle affixed to the first side section and the second side section to allow the mat to be carried while folded into the U-shape.

4. The apparatus of claim 1 further comprising:

a closure mechanism that fastens the first side section to the second side section in the U-shape so that the mat acts as a pouch when folded.

5. The apparatus of claim 4 wherein:

the closure mechanism comprises a zipper or a magnetic closure.

6. The apparatus of claim 1 wherein:

the center section includes a crease that collects the make-up residue when the mat is folded.

7. The apparatus of claim 1 further comprising:

rigid members affixed to at least a portion of the perimeter of the first side section and the second side section.

8. An apparatus comprising:

a mat configured to collect make-up residue, the mat comprising:

a first side section and a second side section connected by a center section;

the first side section and the second side section connect to the center section so that the mat is able to lie substantially flat to allow for collection of make-up residue that falls on top surfaces of the first side section, the second side section, and the center section;

the first side section and the second side section are also connected to the center section so that the mat is able to fold into a U-shape so that the make-up residue resting on the top surfaces of the first side section and the second side section falls into the center section to allow the make-up residue to be poured from the center section;

a closure mechanism that fastens the first side section to the second side section in the U-shape so that the mat acts as a bag when folded; and a pour spout that unfolds to extend outward from the center section to assist in pouring the make-up residue from the center section;

the pour spout folds into the center section when not in use.

9. The apparatus of claim 8 further comprising:

at least one weight affixed internally to the first side section and the second side section to assist in holding the mat substantially flat when opened.

10. The apparatus of claim 8 further comprising:

a carry handle affixed to the first side section and the second side section to allow the mat to be carried while folded into the U-shape.

11. The apparatus of claim 8 wherein:

the closure mechanism comprises a zipper or a magnetic closure.

12. The apparatus of claim 8 further comprising:

rigid members affixed to at least a portion of the perimeter of the first side section and the second side section.

13. An apparatus comprising:

a mat configured to collect make-up residue, the mat comprising:

a first side section;

a second side section; and a center section;

wherein the first side section and the second side section are connected to the center section so that the major planes of the sections are able to lie substantially co-planar when the mat is open to allow for collection of make-up residue that falls on top surfaces of the first side section, the second side section, and the center section;

wherein the top surfaces of the first side section, the second side section, and the center section are made from a non-stick material;

wherein the first side section and the second side section are connected to the center section so that the first and second side sections are able to fold about the center section into a U-shape so that the make-up residue resting on the top surfaces of the first side section and the second side section falls into the center section to allow the make-up residue to be poured from the center section;

at least one weight affixed internally to the first side section and the second side section to assist in holding the first side section and the second side section substantially co-planar with the center section when the mat is open; and a pour spout that unfolds to extend outward from the center section to assist in pouring the make-up residue from the center section, and folds into the center section when not in use.

14. The apparatus of claim 13 further comprising:

a carry handle affixed to the first side section and the second side section to allow the mat to be carried while folded into the U-shape.

15. The apparatus of claim 13 further comprising:

a closure mechanism that fastens the first side section to the second side section in the U-shape so that the mat acts as a pouch when folded.

16. The apparatus of claim 15 wherein:

the closure mechanism comprises a zipper or a magnetic closure.

* * * * *